United States Patent [19]

Wakamatsu et al.

[11] 4,425,762

[45] Jan. 17, 1984

[54] METHOD AND SYSTEM FOR CONTROLLING BOILER SUPERHEATED STEAM TEMPERATURE

[75] Inventors: Hidekazu Wakamatsu, Kodaira; Yoichiro Kogure, Tama, both of Japan

[73] Assignee: Tokyo Shibaura Denki Kabushiki Kaisha, Kanagawa, Japan

[21] Appl. No.: 372,339

[22] Filed: Apr. 27, 1982

[30] Foreign Application Priority Data

Apr. 28, 1981 [JP] Japan ..... 56-63432

[51] Int. Cl.[3] ..... F01K 13/02

[52] U.S. Cl. ..... 60/646; 60/660; 60/667

[58] Field of Search ..... 60/646, 657, 660, 664, 60/665, 667

[56] References Cited

U.S. PATENT DOCUMENTS 4,329,592 11/1982 Wagner et al. ..... 60/660

4,355,514 10/1982 Reifenberg ..... 60/660

*Primary Examiner*—Allen M. Ostrager

*Attorney, Agent, or Firm*—Oblon, Fisher, Spivak, McClelland & Maier

[57] ABSTRACT

A method and system for the temperature control of superheated steam in a power plant having a boiler coupled to a turbine, and a turbine bypass valve, wherein temperature control is achieved by regulating opening of the turbine bypass valve. To this end, process quantities indicative of the superheated steam temperature at the boiler outlet, the superheated steam pressure, the turbine inlet temperature, the turbine inner wall metal temperature, and the degree of opening of the turbine bypass valve are fed into a control system in which a mismatch temperature capable of leading steam into the turbine is calculated on the basis of such received process quantities. Then the control system outputs opening or closing operation command signals to the turbine bypass valve. The method is suitable to be carried out by means of a microprocesser.

16 Claims, 7 Drawing Figures

METHOD AND SYSTEM FOR CONTROLLING BOILER SUPERHEATED STEAM TEMPERATURE

BACKGROUND OF THE INVENTION

1. Field of the Invention

This invention relates generally to a method and system for controlling the temperature of superheated steam generated within a boiler, and more particularly to method and system for controlling boiler-superheated steam temperature in the process of starting up the boiler attendant to turbine start-up in a power plant provided with a turbine bypass valve.

2. Description of the Prior Art

Some power plants are provided with a turbine bypass valve in parallel with a main steam stop valve and a turbine so as to cause superheated steam generated within a boiler to be led directly into a condenser. The turbine bypass valve serves to bypass surplus superheated steam so as not to lead it into the turbine to protect the turbine. Assuming that an electric generator in a power plant is interrupted upon occurrence of load interruption in the power transmission system, the power plant becomes unable to supply power to the transmission system, so that turbine no longer needs abundant superheated steam. Should the same amount of flow of superheated steam as in a rated load operation be led into the turbine even after interruption from the transmission system, the turbine will unnecessarily undergo accelerated rotation which may result in mechanical damage. Thus, in such event, the turbine bypass valve is opened so that surplus superheated steam may be led directly into the condenser so as to protect the turbine. Naturally, when the electric generator is interrupted from the power transmission system, a control will be made such that the flow rate of the superheated steam generated within the boiler is suppressed. However, the response characteristics of such control is extremely slow, so that as described above, the power plant is provided with the turbine bypass valve.

As seen above, the turbine bypass valve per se is intended only for such emergency use as the above-described load interruption in the power transmission system, so that it essentially does not participate in the temperature control of superheated steam in the process of starting up the boiler attendant to turbine start-up. Therefore, even when a power plant is provided with the turbine bypass valve, there is no difference between a power plant without the turbine bypass valve in terms of the temperature control of superheated steam in the process of starting up a boiler attendant to turbine start-up, and such temperature control has been carried out so far in a manner as nextly described.

In general, the temperature control of superheated steam in the region of lower boiler load, i.e. in the process of boiler starting up is said to be complicated and difficult due to its non-linear process gain characteristics. Also it is generally known that the response of the superheated steam with respect to changes of combustion gas temperature or fuel flow rate at the boiler furnace outlet is slow, so that the response characteristics of the control system is inferior. Thus, it takes a substantially lengthy time to obtain a superheated steam condition (e.g. superheated steam temperature meeting certain specified value) required at the instant of turbine start-up (leading steam into turbine). In addition, the superheated steam condition required when leading steam into the turbine varies depending upon a "mode"

of the individual power plant so that the control of superheated steam should be made so as to conform to the individual "mode". For instance, in the case of a "hot mode" in which the boiler and turbine have higher remaining heat, the superheated steam condition should be in a higher temperature mode, and to the contrary, in the case of a "cold mode", the superheated steam condition should be in a lower temperature mode, otherwise it may result in occurrence of thermal fatigue on the turbine inner metal. Such modes are generally determined on the basis of process quantities indicative of the turbine start-up mode, such as the inner metal temperature of the first stage steam chamber of the turbine. As described above, the superheated steam condition required at the instant of leading steam into the turbine varies depending upon a mode of individual power plant, so that the temperature control of superheated steam is generally said to be complicated and difficult.

For controlling such superheated steam temperature, there is provided a boiler controlling apparatus, which includes two temperature control functions, including a first temperature control function that raises temperature and pressure of fluid at the water-cooling wall outlet of the boiler, and a second temperature control function that maintains the superheated steam temperature of the boiler outlet at a temperature capable of leading the steam into the turbine. The second temperature control function maintains the superheated steam temperature of the boiler outlet at a temperature capable of leading the steam into the turbine by controlling a combustion gas temperature at the boiler furnace outlet. Namely, after the boiler has started up, the boiler controlling apparatus firstly controls, by the function of the first temperature control function, to raise the temperature and pressure of the fluid at the water-cooling wall and to obtain superheated steam. When superheated steam is obtained, the second temperature control function then controls a combustion gas temperature at the boiler furnace outlet so as to cause the superheated steam temperature at the boiler outlet to become a temperature capable of leading steam into the turbine. This obtains the superheated steam in conformance with the mode of the power plant, and enables the turbine to safely start up.

Now, during the execution of such control, the turbine is not started up, namely prior to leading the steam into the turbine, so that the main steam stop valve is usually closed, thus the flow rate of the superheated steam is scarcely increased. Namely, the superheated steam can hardly flow, so that temperature rises of the superheated steam at the boiler outlet and the turbine inlet are extremely slow. Thus, it requires a longer time for the superheated steam temperature at the boiler outlet to reach the temperature capable of leading the steam into the turbine. This prevents the turbine from rapidly starting up and inevitably limits the turbine response to a certain extent. That is, this has become an obstacle in terms of carrying out a peak load power generation in which a quick power plant start-up response is required. Should the superheated steam be led into the turbine in an attempt at quicker power plant start-up in spite of the fact that the superheated steam temperature has not reached the temperature capable of leading the steam into the turbine, there results in occurrence of thermal fatigue on the inner metal of the turbine which adversely affects the turbine as such, so that such operation is not preferable for the sake of security.

As described above, the flow of superheated steam is scarcely present in the process of boiler starting up attendant to turbine start-up in the previous method of control, so that a considerably longer time has been required to obtain the necessary condition for superheated steam to be led into the turbine.

SUMMARY OF THE INVENTION

Accordingly, one object of this invention is to provide new and improved method and system for controlling boiler superheated steam temperature which can rapidly obtain the superheated steam temperature condition capable of leading steam into the turbine, by virtue of temperature control of superheated steam in conformity with the mode of the power plant to be controlled.

Briefly, in accordance with one aspect of this invention, there is provided a method for controlling boiler superheated steam temperature in a power plant having a boiler for generating superheated steam, a turbine to be rotated by the superheated steam generated within the boiler, an electric generator coupled to the turbine for generating electric power, a condenser for condensing the superheated steam spent within the turbine, a water-feed pump for feeding water from the condenser into the boiler, a main steam stop valve disposed between the boiler and the turbine for stopping the superheated steam flowing into the turbine, a turbine bypass valve connected in parallel with the main steam stop valve and the turbine for leading the superheated steam generated within the boiler into the condenser, a first sensor for detecting a first process quantity indicative of the superheated steam temperature at the boiler outlet, a second sensor for detecting a second process quantity indicative of the superheated steam pressure, a third sensor for detecting a third process quantity indicative of the temperature at the turbine inlet, a fourth sensor for detecting a fourth process quantity indicative of start-up mode of the turbine, and a fifth sensor for detecting a fifth process quantity indicative of opening of the turbine bypass valve, the method including steps of calculating a first mismatch temperature value of the turbine on the basis of the second process quantity, the third process quantity and the fourth process quantity, calculating a second mismatch temperature value capable of leading the superheated steam into the turbine on the basis of the fourth process quantity and comparing the first mismatch temperature value with the second mismatch temperature value.

The method according to the present invention also includes the steps of calculating an open-direction drive quantity of the turbine bypass valve on the basis of the fourth process quantity when it is judged that the first mismatch temperature value is less than the second mismatch temperature value, and calculating a close-direction drive quantity of the turbine bypass valve on the basis of the first mismatch temperature value when it is judged that the first mismatch temperature value exceeds the second mismatch temperature value.

The method according to the present invention further includes steps of calculating the change rate of the first process quantity, comparing the calculated change rate with a predetermined change rate, and producing a first lock signal when the calculated change rate is smaller than the predetermined change rate, calculating a difference between the first process quantity and the third process quantity, comparing the calculated difference with a predetermined value, and producing a second lock signal when the calculated difference is smaller than the predetermined value, outputting an open-direction operation command signal of the turbine bypass valve on the basis of the open-direction drive quantity, the first lock signal and the second lock signal, and outputting a close-direction operation command signal of the turbine bypass valve on the basis of the close-direction drive quantity and the fifth process quantity.

Also according to the present invention, there is provided a system for controlling boiler superheated steam temperature of a power plant having a boiler for generating superheated steam, a turbine to be rotated by the superheated steam generated within the boiler, an electric generator coupled to the turbine for generating electric power, a condenser for condensing the superheated steam spent within the turbine, a water-feed pump for feeding water from the condenser into the boiler, a main steam stop valve disposed between the boiler and the turbine for stopping the superheated steam flowing into the turbine, a turbine bypass valve connected in parallel with the main steam stop valve and the turbine for leading the superheated steam generated within the boiler into the condenser, a first sensor for detecting a first process quantity indicative of the superheat steam temperature at the boiler outlet, a second sensor for detecting a second process quantity indicative of the superheated steam pressure, a third sensor for detecting a third process quantity indicative of the temperature at the turbine inlet, a fourth sensor for detecting a fourth process quantity indicative of a start-up mode of the turbine, and a fifth sensor for detecting a fifth process quantity indicative of opening of the turbine bypass valve; wherein the system includes a mismatch temperature calculating unit connected to receive the second, third and fourth process quantities detected by the second, third and fourth sensors, respectively, for calculating and outputting a first mismatch temperature value of the turbine on the basis of the received process quantities a calculator/comparator unit connected to receive the first mismatch temperature value of the turbine and the fourth process quantity for obtaining a second mismatch temperature value capable of leading the superheated steam into the turbine on the basis of the fourth process quantity for comparing the first mismatch temperature value with the second mismatch temperature value, for outputting a first compared result signal when it is judged that the first mismatch temperature value is less than the second mismatch temperature value, and for outputting a second compared result signal when it is judged that the first mismatch temperature value exceeds the second mismatch temperature value.

The system also includes a first drive quantity calculating unit connected to receive the first compared result signal and the fourth process quantity for calculating and outputting an open-direction drive quantity of the turbine bypass valve on the basis of the first compared result signal and the fourth process quantity; and a second drive quantity calculating unit connected to receive the second compared result signal and the first mismatch temperature value for calculating and outputting a close-direction drive quantity of the turbine bypass valve on the basis of the second comparative result signal and the first mismatch temperature value.

The system further includes a temperature change rate calculating comparator connected to receive the first process quantity for calculating a change rate of the received first process quantity, for comparing the calculated change rate with a predetermined change rate, and for outputting a first lock signal when the calculated change rate is smaller than the predetermined change rate; a temperature difference calculating comparator connected to receive the first process quantity and the third process quantity for calculating a difference between the first process quantity and the third process quantity for comparing the calculated difference with a predetermined value, and for outputting a second lock signal when the calculated difference is smaller than the predetermined value; a first operation command output unit connected to receive the open-direction drive quantity, the first lock signal, and the second lock signal for outputting an open-direction operation command signal of the turbine bypass valve on the basis of the open-direction drive quantity, and the first and second lock signals; and a second operation command output unit connected to receive the close-direction drive quantity and the fifth process quantity indicative of the turbine bypass valve opening detected by the fifth sensor for outputting a close-direction operation command signal of the turbine bypass valve on the basis of the close-direction drive quantity and the fifth process quantity.

BRIEF DESCRIPTION OF THE DRAWINGS

A more complete appreciation of the invention and many of the attendant advantages thereof will be readily obtained as the same become better understood by reference to the following detailed description when considered connection with the accompanying drawings, wherein.

DESCRIPTION OF THE PREFERRED EMBODIMENTS

Figure 1:
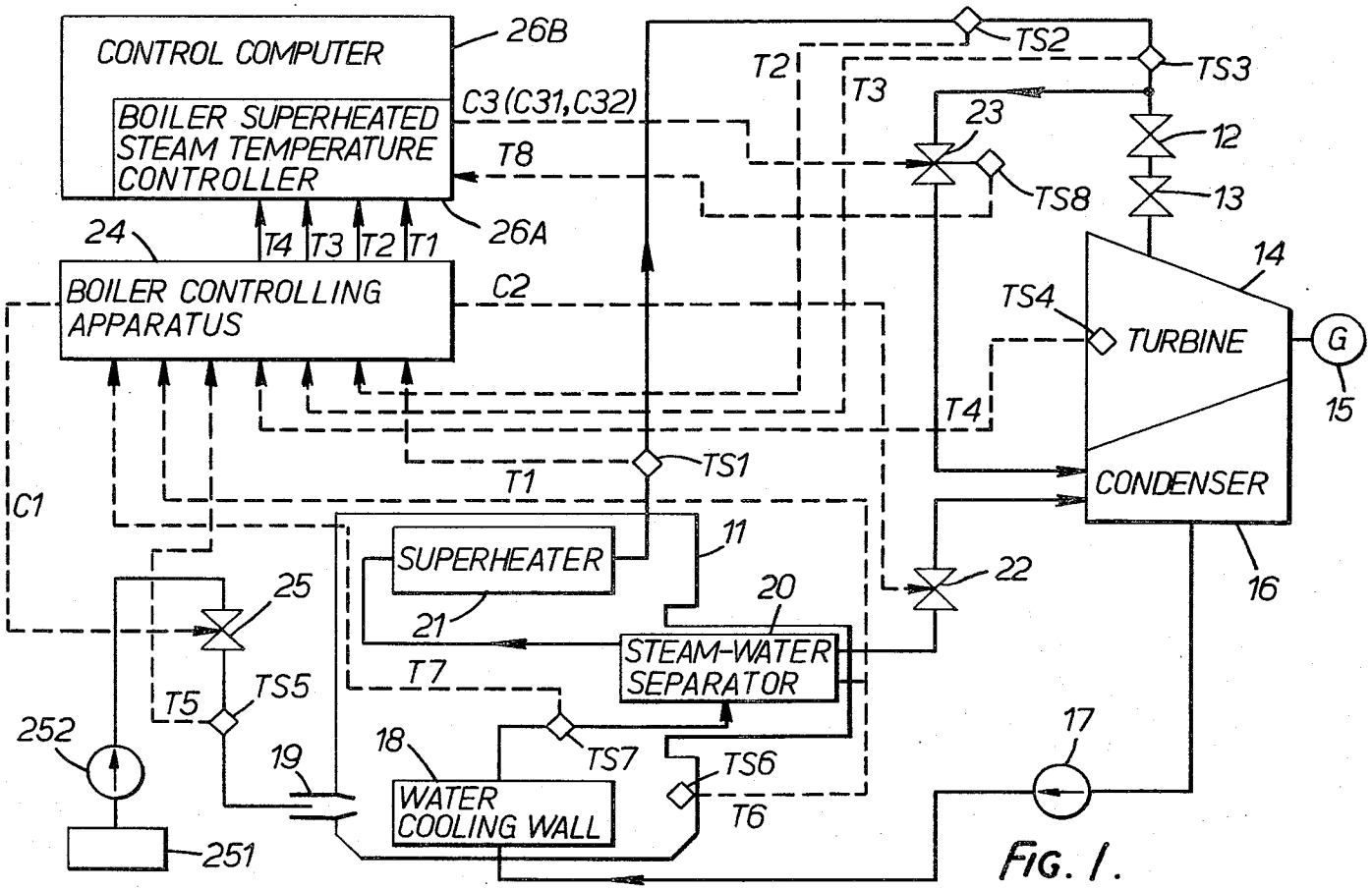
FIG. 1 is a schematic diagram illustrating a power plant to be controlled by the method and system according to the present invention.

Referring now to the drawings, wherein like reference numerals designate identical or corresponding parts throughout the several views, and more particularly to FIG. 1 thereof, one embodiment of this invention is nextly described. As well known, in a power plant, superheated stem generated within a boiler 11 is led into a turbine 14 through a main steam stop valve 12 and a control valve 13, then drives the turbine 14 to rotate an electric generator 15. The superheated steam spent within the turbine 14 is condensed into water by a condenser 16, and fed into the boiler 11 by means of a water-feed pump 17. The water fed into the boiler 11 is led into a water cooling wall 18, where it is heated by a burner 19. The fluid (mixed steam and water) from the water cooling wall 18 is separated into steam and water by a steam-water separator 20, then the separated steam is further led into a superheater 21, where it becomes superheated steam at high temperature and pressure, and is led out from the outlet of the boiler 11.

Now, a part of the steam generated within the steam-water separator 20 is possibly, if required, led into the condenser 16 through a relief valve 22. This it utilized mainly to control the temperature and pressure of superheated steam. A turbine bypass valve 23 is disposed in parallel with the series of main steam stop valve 12, the control valve 13, and the turbine 14. The turbine bypass valve 23 per se, as described above, is provided for the purpose of leading surplus superheated steam directly into the condenser 16. According to the present invention, this turbine bypass valve is utilized for the purpose of the temperature control of superheated steam in the process of boiler starting up to turbine start-up. This will be described in detail hereinafter.

Nextly, the boiler controlling apparatus 24 receives such process quantities as follows: a superheated steam temperature $T_1$ of the boiler outlet detected by a sensor $R_{s1}$, a superheated steam pressure $T_2$ detected by a sensor $T_{s2}$, a temperature $T_3$ of the turbine inlet detected by a sensor $T_{s3}$, an inner-wall metal temperature $T_4$ of the first-stage steam chamber of the turbine detected by a sensor $T_{s4}$, a fuel flow rate $T_5$ of the burner 19 detected by a sensor $T_{s5}$, a combustion gas temperature $T_6$ of the furnace outlet detected by a sensor $T_{s6}$, and a fluid temperature $T_7$ of the water-cooling wall outlet detected by a sensor $T_{s7}$. The boiler controlling apparatus 24 outputs, on the basis of such process quantities received, a regulation command signal $C_1$ to be fed into a fuel regulating valve 25 which regulates the fuel flow rate $T_5$, and also outputs a regulation command signal $C_2$ to be fed into a steam relief valve 22, and performs the temperature control of the superheated steam. This temperature control is performed by virtue of the above-described first and second temperature control functions. Fuel reserved within a fuel tank 251 is supplied into the burner 19 by means of a fuel supply pump 252.

A boiler superheated steam temperature controller 26A, according to the present invention, carries out the temperature control of superheated steam by controlling the bypass valve 23 in the process of boiler starting up to turbine start-up. The controller 26A receives such process quantities as the superheated steam temperature $T_1$ of the boiler outlet, the superheated steam pressure $T_2$, the temperature $T_3$ of the turbine inlet, the first-stage steam-chamber inner-wall metal temperature $T_4$ of the turbine and an opening $T_8$ of the turbine bypass valve 23 detected by a sensor $T_{s8}$. Although the controller 26A indirectly receives, as shown in FIG. 1, through the boiler controlling apparatus 24 the superheated steam temperature $T_1$ of the boiler outlet, the superheated steam pressure $T_2$, the turbine inlet temperature $T_3$, and the first-stage steam-chamber inner-metal temperature $T_4$ of the turbine, such process quantities may also be fed into the controller 26 directly from respective sensors $T_{s1}$, $T_{s2}$ and $T_{s4}$.

The controller 26A, on the basis of such received quantities, calculates a drive quantity of the turbine bypass valve 23 required for the temperature control of the superheated steam, also judges whether the turbine bypass valve 23 may be opened, and then outputs an operation command signal $C_3$ to regulte the turbine bypass valve 23. The operation command signal $C_3$ consists of an open-direction operation command signal $C_{31}$ and a close-direction operation command signal $C_{32}$, which are described hereinafter.

A control computer 26B is designed to execute an overall supervisory control for the power plant, and has a large number of control functions. Although not shown in the Figure, the control computer 26B receives various process quantities other than that described above as well. On the basis of the received various process quantities, the control computer 26B outputs operation start-up commands and operation terminate commands which are fed into the boiler controlling apparatus 24 and the controller 26 or other various controlling apparata or units (not shown), also outputs plural commands to be fed into the main steam stop valve 12 and the control valve 13, and executes overall supervisory control of the power plant.

Figure 2:
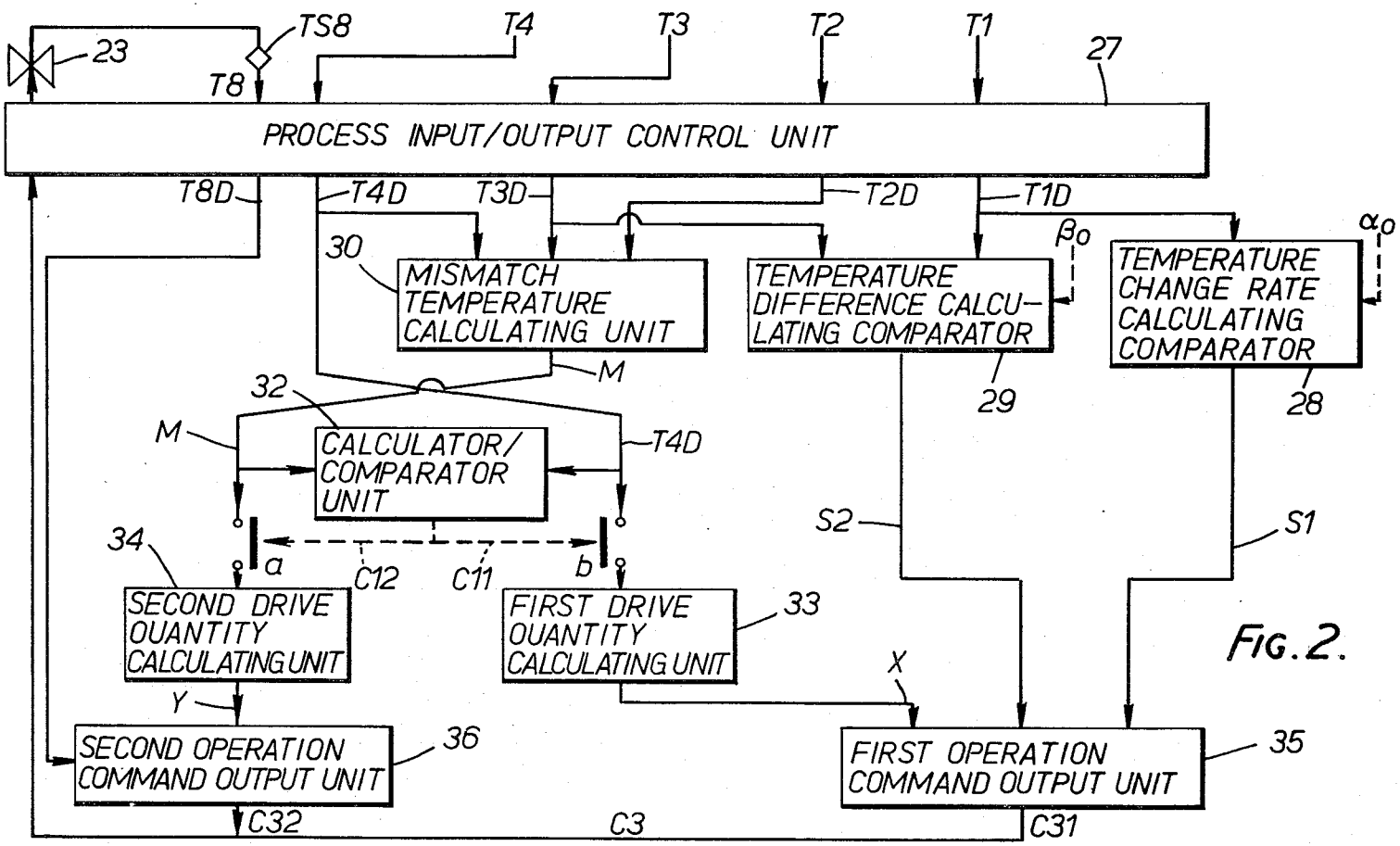
FIG. 2 is a block diagram of the system for controlling boiler superheated temperature according to the present invention.

FIG. 2 is a block diagram illustrating the system for controlling boiler superheated steam temperature according to one embodiment of the present invention. In FIG. 2, a process input/out control unit 27 receives such process quantities as the superheated steam temperature $T_1$ of the boiler outlet, the superheated steam pressure $T_2$, the turbine inlet temperature $T_3$, the first-stage steam-chamber inner-wall metal temperature $T_4$ of the turbine, and the opening $T_8$ of the turbine bypass valve 23, and converts such received process quantities into digital quantities, which are respectively designated the superheated steam temperature $T_{1D}$ of the boiler outlet, the superheated steam pressure $T_{2D}$, the turbine inlet temperature $T_{3D}$, the first-stage steam-chamber inner-wall metal temperature $T_{4D}$, and the opening $T_{8D}$ of the turbine bypass valve 23.

A temperature change rate calculating comparator 28 first receives the superheated steam temperature $T_{1D}$ of the boiler outlet, and calculates a change rate $\alpha$ with respect to time, then compares the thus calculated change rate $\alpha$ with a predetermined change rate $\alpha_0$, and outputs a lock signal $S_1$ when the calculated change rate $\alpha$ is smaller than the predetermined change rate $\alpha_0$. The predetermined change rate $\alpha_0$ is determined a positive value indicative of that the superheated steam temperature is being raised. Thus, the temperature change rate calculating comparator 28 does not output the lock signal $S_1$ when the superheated steam temperature is being raised at a change rate greater than the perdetermined change rate $\alpha_0$.

On the other hand, a temperature difference calculating comparator 29 calculates a temperature $\beta(\beta=T_{1D}-T_{3D})$ between the superheated steam temperature $T_{1D}$ of the boiler outlet and the turbine inlet temperature $T_{3D}$, then compares the thus calculated temperature difference b with a predetermined temperature difference $\beta_0$ and outputs a lock signal $S_2$ when the calculated temperature difference $\beta$ is smaller than the predetermined temperature difference $\beta_0$. The predetermined rate $\beta_0$ is determined to be such a value that the turbine inlet metal temperature is not cooled by the effect of the superheated steam. For example, the change rate $\beta_0$ is determined a positive value indicative of that the superheated steam temperature $T_{1D}$ of the boiler outlet is higher than the turbine inlet temperature $T_{3D}$, or a negative value indicative of that the superheated steam temperature $T_{1D}$ of the boiler outlet is slightly lower than the turbine inlet temperature $T_{3D}$. Thus, the temperature difference calculating comparator 29 does not output a lock signal $S_2$ when the superheated steam is not in danger of cooling the turbine inlet metal.

Nextly, a mismatch temperature calculating unit 30 receives such process quantities as the superheated steam pressure $T_{2D}$, the turbine inlet temperature $T_{3D}$, and the first-stage steam-changer inner-wall metal temperature $T_{4D}$ of the turbine, and calculates a mismatch temperature M on the basis of such received process quantities. The mismatch temperature M is defined by a difference between a steam temperature of the first-stage steam chamber outlet of the turbine and the first-stage steam-chamber inner-wall metal temperature $T_{4D}$ of the turbine. Thus the mismatch temperature calculating unit 30 firstly calculates the steam temperature of the first-stage steam chamber outlet of the turbine, then obtains a difference between the thus calculated value and the first-stage steam-chamber inner-wall metal temperature $T_{4D}$ of the turbine, and obtains the mismatch temperature M. The steam temperature of the first-stage steam chamber outlet of the turbine is an anticipated value of the steam temperature at the first-stage steam chamber outlet which is anticipated to be obtained under such a condition that the superheated steam is led into the turbine. Therefore, the steam temperature of the first-stage steam chamber outlet of the turbine is calculated on the basis of process quantities, such as the superheated steam pressure $T_{2D}$ and the turbine inlet temperature $T_{3D}$ indicative of conditions of the superheated steam at such an instant that leading steam into the turbine is assumed. The operational equation for calculating the steam temperature of the first-stage steam-chamber outlet of the turbine is, although varied depending upon types and forms of the turbine, generally well known.

The mismatch temperature M is calculated is supplied, together with the first-stage steam-chamber inner-wall metal temperature $T_{4D}$ of the turbine, to a calculator/comparator unit 32. The calculator/comparator unit 32 calculates a mismatch temperature Ma capable of leading steam into the turbine on the basis of the first-stage steam-chamber inner-wall metal temperature $T_{4D}$ of the turbine, and compares the mismatch temperature M with the mismatch temperature Ma capable of leading steam into the turbine. When the result of comparison shows that the mismatch temperature M is smaller than the mismatch temperature Ma capable of leading steam into the turbine, the calculator/comparator unit 32 outputs a first compared result signal $C_{11}$, but when the result of comparison shows that the mismatch temperature M is greater than the mismatch temperature Ma, it then outputs a second compared result signal $C_{12}$.

Figure 3:
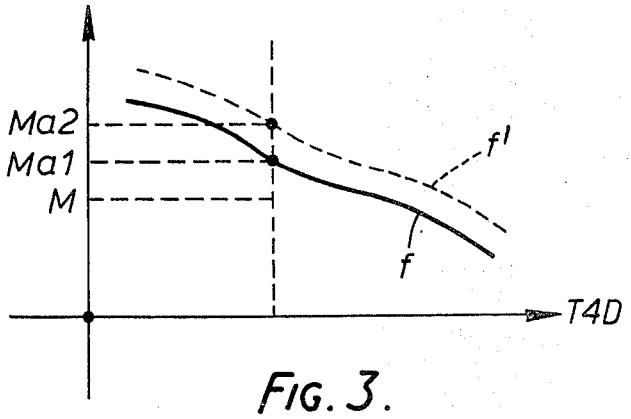
FIG. 3 is a graph presenting the mismatch comparison function indicative of a superheated steam condition capable of leading steam into the turbine.

FIG. 3 shows a characteristic curve indicative of a mismatch comparison function f for calculating the mismatch temperature Ma capable of leading steam into the turbine on the basis of the first-stage steam-chamber inner-wall metal temperature $T_{4D}$. Now assuming that the first-stage steam-chamber inner-wall metal temperature $T_{4D}$ of the turbine is at a value of $T_{4D1}$ as shown in FIG. 3, the mismatch temperature Ma capable of leading steam into the turbine at such instant may be obtained as $Ma_1$ from the mismatch comparison function f. Here, the mismatch temperature Ma capable of leading steam into the turbine has a certain tolerance, to be more exact, falls within such a range as $M_2<Ma<Ma_1$ which is determined by an upper limit mismatch comparison function f' and a lower limit mismatch comparison function f. According to one embodiment of the present invention, the temperature control is made in the process of boiler starting up to turbine start-up, namely such that the mismatch temperature M is being varied from a smaller value to a larger value, so that a value to be determined by the lower mismatch comparison function f is applied as the mismatch temperature Ma capable of leading steam into the turbine. Thus, the lower mismatch comparison function f is merely called a mismatch comparison function f.

Moreover, the mismatch comparison function f is a function indicative of a superheated steam condition capable of leading steam into the turbine, which receives, as a variable, the first-stage steam-chamber inner-wall metal temperature $T_{4D}$ of the turbine indicative of the turbine start-up mode. Namely, when the superheated steam pressure is constant, maintaining the superheated steam temperature to be capable of leading steam satisfies the superheated steam condition capable of leading steam into the turbine. It is therefore indicated that when the first-stage steam-chamber inner-wall metal temperature $T_{4D}$ of the turbine is smaller, the mismatch temperature should be larger, because the difference between the first-stage steam-chamber inner-wall metal temperature $T_{4D}$ and the superheated steam condition capable of leading steam into the turbine will become larger.

A characteristic curve of this function varies will types and capacities of the turbine, so that an accurate characteristic curve should be obtained on the basis of test measurements, however it is generally known as a monotonous decreasing function.

The calculator/comparator unit 32 compares the mismatch temperature $Ma_1$ thus obtained capable of leading steam into the turbine with the mismatch temperature M calculated by the mismatch temperature calculating unit 30. FIG. 3 shows the instance when the mismatch temperature $Ma_1$ is greater than the mismatch temperature M. In this case, the calculator/comparator unit 32 outputs a first compared result signal $C_{11}$. Namely, it represents that the superheated steam is insufficiently heated.

When the calculator/comparator unit 32 outputs the first compared result signal $C_{11}$, that is, when the superheated steam is insufficiently heated, a contact b is closed (in this case, a contact a is open), then the first-stage steam-chamber inner-wall metal temperature $T_{4D}$ is supplied into a first drive quantity calculating unit 33.

Figure 4:
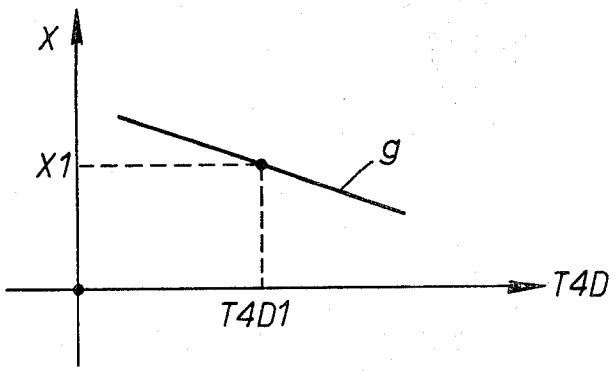
FIG. 4 is a graph presenting the characteristics illustrating the open-direction target drive quantity function of the turbine bypass valve.

The first drive quantity calculating unit 33 calculates, on the basis of the first drive quantity target function g shown in FIG. 4, an open-direction drive quantity X of the turbine bypass valve 23 from the first-stage steam-chamber inner-wall metal temperature $T_{4D}$. Namely, when the superheated steam is heated insufficiently, the first drive quantity calculating unit 33 calculates the drive quantity X so as to increase the flow rate of the superheated steam by regulating the turbine bypass valve 23 in the open direction. The characteristic curve of the first drive quantity target function g is varied depending upon types and capacities of the turbine or structures of the steam system or the like, so that an accurate characteristic curve should be obtained on the basis of test measurements, however, it should generally be a monotonous decreasing function as shown in FIG. 4. This is because when the process quantity indicative of turbine start-up mode, that is, the first-stage steam-chamber inner-wall metal temperature $T_{4D}$ of the turbine, is larger, the power plant is in a "hot mode", so that the opening of the turbine bypass valve 23 should be smaller. Namely, this is intended so that the steam tube should not be cooled, because there is provided a reverse response characteristic such that should the opening of the turbine bypass valve 23 be so increased as to increase abruptly the flow rate of the superheated steam, the temperature of the superheated steam is temporarily lowered.

The drive quantity X in the open direction calculated by the first drive quantity calculating unit 33 is supplied through a first operation command output unit 35 to the turbine bypass valve as the open-direction operation command signal $C_{31}$, however, the supply of this signal is blocked by the first operation command output unit 35 in the presence of the above-described first lock signal $S_1$ or the second lock signal $S_2$.

As described above, when the temperature of the superheated steam is not raised up to a temperature such that it does not cool the steam tubes and the turbine metal, the temperature difference calculating comparator 29 outputs the second lock signal $S_2$. Therefore, for instance, in the "hot mode" of the power plant, even when the temperature of the superheated steam is raised up to a temperature of such extent that it does not cool the steam tubes or turbine metal in the case of the "cold mode" of the power plant the temperature difference calculating comparator 29 possibly outputs the second lock signal $S_2$. This prevents the superheated steam from cooling the steam tubes or the turbine metal when the power plant is in the "hot mode".

On the other hand, the temperature change rate calculating comparator unit 28 outputs the first lock signal $S_1$ as long as the temperature of the superheated steam is lowering, even in case the temperature of the superheated steam has reached a temperature of such extent that it does not cool the steam tubes and the turbine metal, thus this is a sort of feedforward control. Namely, the temperature change rate calculating comparator unit 28 preparatorily outputs in first lock signal $S_1$ so as to prevent future occurrence of such a state that the temperature of the superheated steam cools the steam tubes or the turbine metal.

Therefore, when the power plant is in the "hot mode", and when the temperature of the superheated steam is not raised to such extent that it does not cool the steam tubes and the turbine metal, the temperature control by regulating opening of the turbine bypass valve 23 is not executed, because no drive operation command is supplied to the turbine bypass valve 23 even when the open-direction target opening X is calculated. Furthermore, even in case the temperature of the superheated steam has raised up to such extent that it does not cool the steam tubes and the turbine metal, if there is a possibility of future occurrence of abnormalities, the temperature control by regulating opening of the turbine bypass valve 23 is also not executed.

Nextly, when the calculator/comparator 32 outputs the second compared result signal $C_{12}$, that is, when the superheated steam is sufficiently heated, the contact a is closed (the contact b is open), and the mismatch temperature M is supplied into the second drive quantity calculating unit 34.

Figure 5:
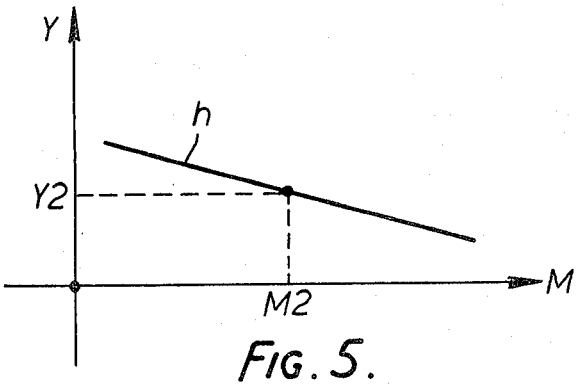
FIG. 5 is a graph presenting the characteristics illustrating the close-direction target drive quantity function of the turbine bypass valve and FIGS. 6A and 6B are a flowchart illustrating operation of one embodiment according to the present invention.

A second drive quantity calculating unit 34 calculates a close-direction drive quantity Y of the turbine bypass valve 23 from the mismatch temperature M at a respective instant on the basis of a second drive quantity target function h shown in FIG. 5. Namely, at the time when the superheated steam is sufficiently heated, the second drive quantity calculating unit 34 calculates the drive quantity Y, which regulates the closing of the turbine bypass valve so as to decrease the flow rate of the steam. The characteristic curve of the second drive quantity target function h varies with the types and capacities of the boiler, and structures of the steam system and the like, so that an accurate characteristics curve should be determined based on test measurements, as is the same in the first drive quantity target function g. But, it should generally be a monotonous decreasing function as shown in FIG. 5. This is because when the mismatch temperature is larger, that is, the power plant is in the hot mode, the close-direction operation quantity of the turbine bypass valve 23 is to be reduced and the superheated steam condition capable of leading steam into the turbine is to be maintained in order to compensate for the decrease of the superheated steam temperature due to heat exchange between the superheated steam and the cooled steam pipe near the turbine inlet.

The close-direction drive quantity Y calculated by the second drive quantity calculating unit 34 is supplied into the second operation command output unit 35, while the opening $T_{8D}$ of the turbine bypass valve 23 is also supplied thereto. The second operation command output unit 36 compares the received opening $T_{8D}$ of the turbine bypass valve 23 with a value of opening converted from the close-direction drive quantity Y, and when the opening $T_{8D}$ of the turbine bypass valve 23 is greater than the thus converted value of opening, then outputs the close-direction operation command signal $C_{32}$ corresponding to close-direction drive quantity Y.

This close-direction operation command signal $C_{32}$ and the aforementioned open-direction operation command signal $C_{31}$ are supplied to the turbine bypass valve 23 through the process input/output control unit 27 in which such signals are converted in forms such as a digital or an analog quantity. When a drive mechanism to drive the turbine bypass valve 23 is operated by an analog quantity, the process input/output control unit 27 outputs an analog signal, and when operated by a digital quantity, then outputs a digital signal. Moreover, the process input/output control unit 27 may also be separately constructed as a process input control unit and a process output control unit.

Although the temperature change rate calculating comparator 28, the temperature difference calculating comparator 29, the mismatch temperature calculating unit 30, the calculator/comparator unit 32, the first drive quantity calculating unit 33, the second drive quantity calculating unit 34, the first operation command output unit 35, and the second operation command output 36 are all described as performing all the calculations digitally, they may also be constructed using circuitry in which analog computations are made, and the process input/output control unit 27 may be eliminated. Furthermore, when calculations are made digitally, application of microprocessor technology is most preferable. Therefore the boiler superheated steam temperature controller 26A according to the present invention is not restricted to the above-described embodiment.

Figure 6A:
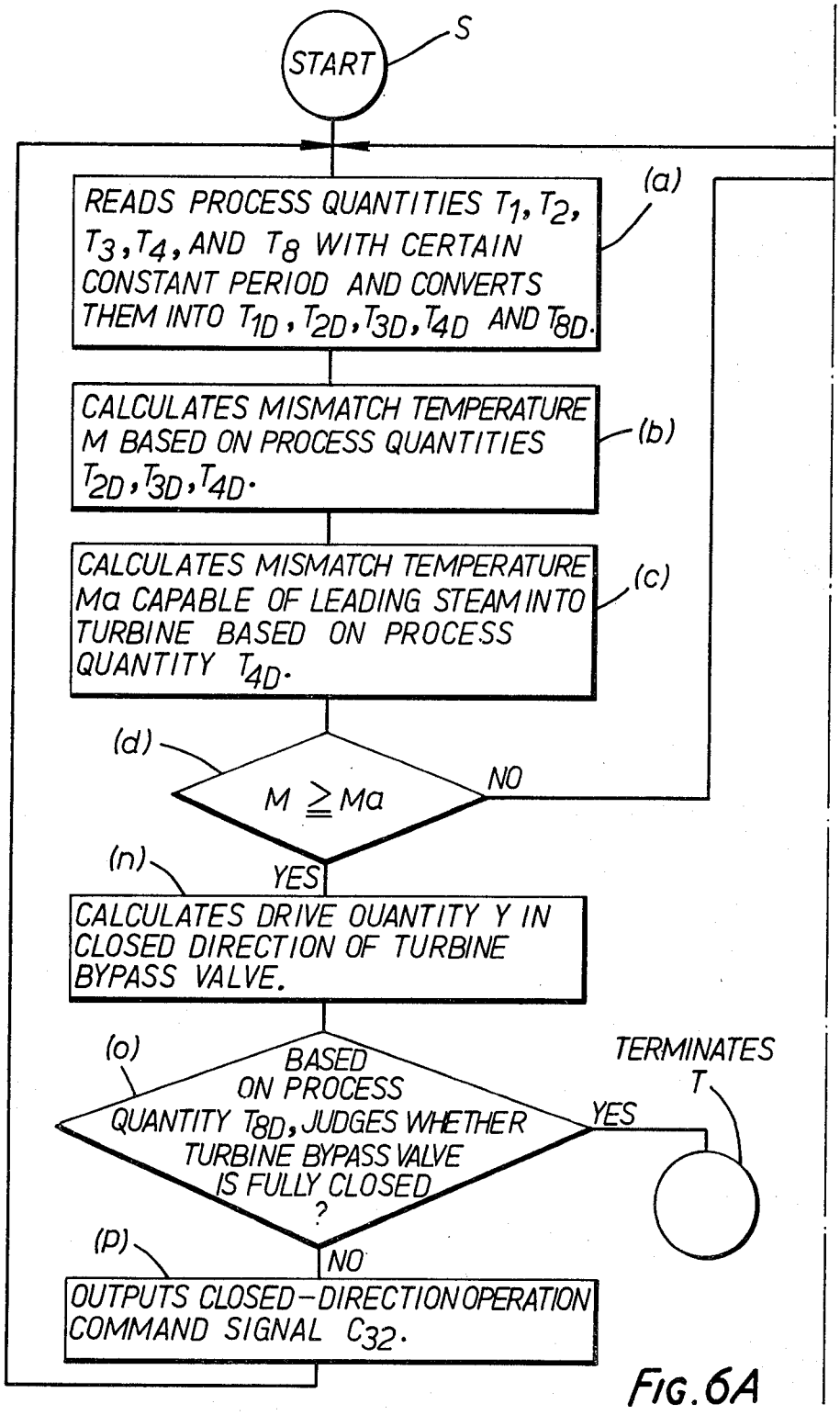
Figure 6B:
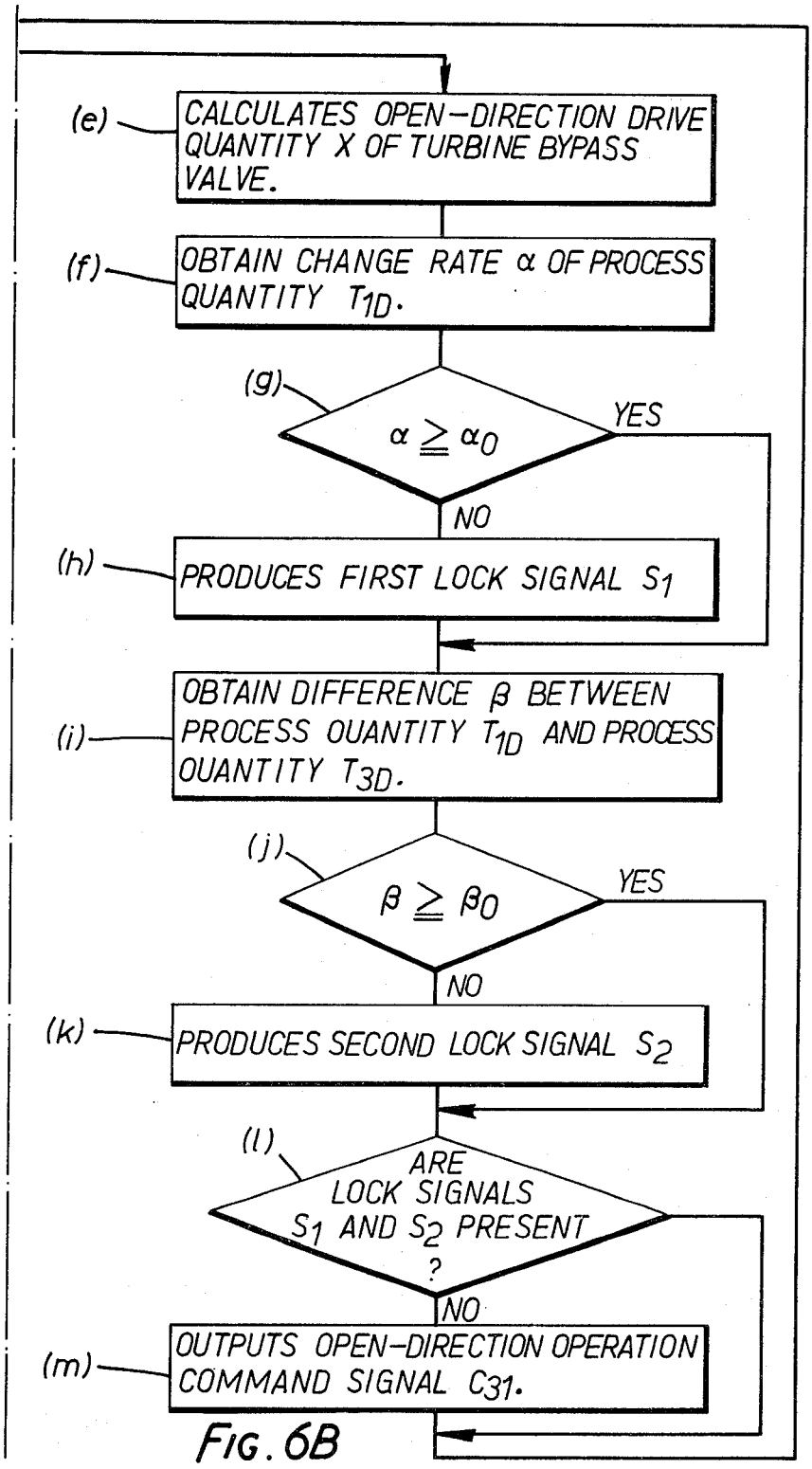

Moreover, while the boiler superheated steam temperature controller 26A is separately constructed from the control computer 26B in the above description, the functions of such controller 26A may be included within the control computer 26B in which all the required calculations may be executed, and one embodiment thereof is shown in FIG. 6.

In FIG. 6, the control computer 26B reads at a certain constant scanning period process quantities required for the temperature control of the open-close operation of the turbine bypass valve, such as the superheated steam temperature $T_1$ of the boiler outlet, the superheated steam pressure $T_2$, the turbine inlet temperature $T_3$, the first-stage steam-chamber inner-wall metal temperature $T_4$ of the turbine, and the opening $T_8$ of the turbine bypass valve, then converts such quantities into digital process quantities such as the superheated steam temperature $T_{1D}$ of the boiler outlet, the superheated steam pressure $T_{2D}$, the turbine inlet temperature $T_{3D}$, the first-stage steam-chamber inner-wall metal temperature $T_{4D}$, and the opening $T_{8D}$ of the turbine valve (a), and calculates the mismatch temperature M of the turbine at each respective instant on the basis of the superheated steam pressure $T_{2D}$, the turbine inlet temperature $T_{3D}$, and the first-stage steam-chamber inner-wall metal temperature $T_{4D}$ of the turbine (b).

The mismatch temperature M of the turbine is defined, as described above, by the difference between the steam temperature of the first-stage steam chamber outlet of the turbine and the first-stage steam-chamber inner-wall metal temperature $T_{4D}$, so that the control computer 26B firstly calculates the steam temperature of the first-stage steam chamber outlet of the turbine, and obtains the difference between the thus calculated steam temperature and detected value, that is, the first-stage steam-chamber inner-wall metal temperature $T_{4D}$ of the turbine, and calculates the mismatch temperature M. The steam temperature of the first-stage steam chamber outlet of the turbine is an anticipated value of the steam temperature at the first-stage steam chamber outlet of the turbine to be obtained under a condition of the superheated steam which is let into the turbine with certain condition. Therefore, the steam temperature of the first-stage steam chamber outlet of the turbine is calculated on the basis of the process quantities indicative of a condition of the superheated steam at the instant when it was assumed to lead steam into the turbine, namely such as the superheated steam pressure $T_{2D}$ and the turbine inlet temperature $T_{3D}$.

Next, the control computer 26B calculates the mismatch temperature Ma capable of leading steam into the turbine on the basis of the first-stage steam-chamber inner-wall metal temperature $T_{4D}$ of the turbine (c). The mismatch temperature Ma capable of leading steam into the turbine may be obtained from the first-stage steam-chamber inner-wall metal temperature $T_{4D}$ of the turbine and the mismatch comparison function f shown in FIG. 3.

The control computer 26B compares the mismatch temperature M with the mismatch temperature Ma capable of leading steam into the turbine (d). When the result of comparison shows that the mismatch temperature M is smaller than the mismatch temperature Ma, this indicates the superheated steam is heated insufficiently, so that the control computer 26B calculates an open-direction drive quantity X of the turbine bypass valve (e). This open-direction drive quantity X is calculated on the basis of the first drive quantity target function g shown in FIG. 4 and the first-stage steam-chamber inner-wall metal temperature $T_{4D}$. Namely, when the superheated steam is heated insufficiently, the control computer 26B calculates a drive quantity X that regulates the turbine bypass valve 23 in the open direction so as to increase the flow rate of superheated steam.

Nextly the control computer 26B calculates a change rate a with respect to time of the superheated steam temperature $T_{1D}$ of the boiler outlet (f), then compares the thus calculated change rate a with a predetermined change rate $\alpha_0$ (g), and when the thus calculated change rate $\alpha$ is smaller than the predetermined change rate $\alpha_0$, outputs the lock signal $S_1$(h). Here, as the predetermined change rate $\alpha_0$ is determined, a positive value is indicative that the superheated steam temperature is rising. Therefore, when the superheated steam temperature is being raised at a change rate greater than the predetermined change rate $\alpha_0$, the lock signal $S_1$ is not outputted.

Furthermore, the control computer 26B calculates a temperature difference $\beta(\beta=T_{1D}-T_{3D})$ between the superheat steam temperature $T_{1D}$ of the boiler outlet of the turbine inlet temperature $T_{3D}$ (i), compares the thus calculated temperature difference $\beta$ with the predetermined temperature difference $\beta_0$ (j), and when the thus calculated temperature difference $\beta$ is smaller than the predetermined temperature difference $\beta_0$, outputs the lock signal $S_2$ (k). Here, the predetermined temperature difference $\beta_0$ is determined to be a value such that the superheated steam does not cool the turbine inlet metal, for example, a positive value indicative that the superheated steam temperature $T_{1D}$ of the boiler outlet is higher than the turbine inlet temperature $T_{3D}$, or a negative value indicative that the superheated steam temperature $T_{1D}$ of the boiler outlet is slightly lower than the turbine inlet temperature $T_{3D}$. Therefore, when there is no possibility that the superheated steam cools the turbine inlet metal, the lock signal $S_2$ is not outputted.

Nextly, the control computer 26B judges whether the first lock signal $S_1$ or the second lock signal $S_2$ is present or not, (l), and when both the signals are absent, outputs the above-described open-direction drive quantity X as the open-direction operation command signal $C_{31}$ to the turbine bypass valve 23 (m).

On the other hand, when the result of the comparison of the mismatch temperature M with the mismatch temperature Ma capable of leading steam into the turbine shows that the mismatch temperature M exceeds the mismatch temperature Ma, that is, when the superheated steam is heated sufficiently, the control computer 26B calculates the close-direction quantity Y of the turbine bypass valve (n). This open-direction drive quantity Y is calculated on the basis of the second drive quantity target function h shown in FIG. 5 and the mismatch temperature M. Namely, when the superheated steam is heated sufficiently, the control computer 26B calculates the drive quantity Y that regulates the turbine bypass valve 23 in a closing direction so as to decrease the steam flow rate.

Nextly, on the basis of the opening $T_{8D}$ of the turbine bypass valve, the control computer 26B judges whether the turbine bypass valve 23 is fully closed (o), and when not fully closed, then outputs the close-direction drive quantity Y as the close-direction operation command signal $C_{32}$ to the turbine bypass valve 23 (p). On the other hand, when the turbine bypass valve 23 is fully closed, the control computer 26B terminates the temperature control of the superheated steam by means of open-close operation of the turbine bypass valve 23.

Now assuming that the power plant is in the "cold mode", and when the burner 19 is ignited, then the temperature control of the superheated steam generated within the boiler is started, the control computer 26B starts the temperature control by open-close operation of the turbine bypass valve 23 in parallel with the temperature control performed by the boiler controlling apparatus 24. As described above, the control computer 26B reads process quantities required for such temperature control and calculates the mismatch temperature M at each respective instant, and also calculates the mismatch temperature Ma capable of leading steam into the turbine at the same instant, and compares these thus calculated values. In the initial period after the ignition of the burner 19, the superheated steam has not be heated yet, so that the mismatch temperature M is smaller than the mismatch temperature Ma capable of leading steam into the turbine. Thus, the control computer 26B calculates the open-direction drive quantity X defined by the first drive quantity target function g shown in FIG. 4 and the first-stage steam-chamber inner-wall metal temperature $T_{4D1}$.

Now, in the initial period after the ignition of the burner 19, the change rate $\alpha$ of the superheated steam temperature $T_{1D}$ of the boiler outlet is greater than the predetermined change rate $\alpha_0$, and the superheated steam temperature $T_{1D}$ of the boiler outlet is also greater than the turbine inlet temperature $T_{3D}$, so that the first lock signal $S_1$ or the second block signal $S_2$ is not outputted. Thus, the turbine bypass valve 23 is opened since the open-direction quantity X is outputted as the open-direction operation command signal $C_{31}$ and supplied thereto. This increase the flow rate of the steam flowing into the condenser 16 through the turbine bypass valve 23, thereby increasing the quantity of heat exchange at the turbine inlet, thus, the temperature rise of the turbine inlet is enhanced.

In this case, the operation to increase opening of the turbine bypass valve 23 temporarily lowers the superheated steam pressure due to the reverse response characteristics. But the boiler controlling apparatus 24 functions to compensate such pressure lowering, for example, by closing the steam relief valve 22 to decrease the quantity of saturated steam which flows out from the steam-water separator 20 into the condenser 16, and thus functions to increase the steam flowing into the superheater 21, thereby enhancing the temperature rise of the turbine inlet.

The temperature of superheated steam is thus raised, however, the mismatch temperature M, along with a rise of the turbine inlet temperature $T_{3D}$, changes to an increasing direction. This is because the superheated steam has not been led into the turbine, thus, there is no flow of steam into the steam chamber of the turbine, and no change of the first-stage steam-chamber inner-wall metal temperature $T_{4D}$ of the turbine. Namely, this is because the mismatch temperature M, should the first-stage steam-chamber inner-wall metal temperature $T_{4D}$ of the turbine be constant, may be represented by the incremental function of the turbine inlet temperature $T_{3D}$.

When the mismatch temperature M changes to an increasing direction along with a rise of the turbine inlet temperature $T_{3D}$ and becomes the mismatch temperature Ma capable of leading steam into the turbine, the control computer 26B calculates the close-direction drive quantity Y of the turbine bypass valve 23. The turbine bypass valve 23 is closed by the thus calculated close direction drive quantity Y. This decreases the flow rate of steam flowing into the condenser 16, also decreases the heat exchange quantity at the turbine inlet, thereby suppressing a rise in the steam temperature at the turbine inlet. After the turbine bypass valve 23 is thus closed, leading steam is introduced into the turbine, and then the control computer 26B terminates the temperature control by regulating the open-close operation of the turbine bypass valve 23.

Nextly, when the power plant is in the "hot mode", the control computer 26B outputs the first lock signal $S_1$ or the second lock signal $S_2$ so as to block the supply of the open-direction operation command signal $C_{31}$ based on the open-direction drive quantity X to the turbine bypass valve 23 until the superheated steam temperature reaches a temperature such that it does not cool the steam tubes and turbine metal. When the superheated steam is raised in temperature and the first lock signal $S_1$ and the second lock signal $S_2$ are released, the same control as in the above-described "cold mode" is performed.

As described above, according to the present invention, on the basis of the process quantities indicative of the turbine start-up such as the first-stage steam-chamber inner-wall metal temperature of the turbine and the mismatch temperature, the control system regulates open-close operation of the turbine bypass valve, and controls a heat exchange quantity between superheated steam and metal at the turbine inlet, so that the temperature control of superheated steam at the turbine inlet can be performed in parallel with temperature control of superheated steam at the boiler outlet. This can reduce the time required to reach the steam condition for the turbine start-up. The required time that can be reduced varies depending upon types of boilers and turbines, or system structure of steam tubes, and specifically, should be obtained from actual measurements on the characteristic test, however, in general, the required time can be reduced to less than half of that of the conventional power plant system.

Furthermore, when the power plant is in the "hot mode", the control system judges the characteristics of superheated steam supplied from the boiler, and when the superheated steam temperature has not been raised such that it does not cool the metal, blocks the operation to set opening of the turbine bypass valve, so that both metal-cooling at the turbine inlet and lowering the turbine inlet temperature can be prevented, and safe power plant operations with rapid start-up can be achieved.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for controlling boiler superheated steam temperature in a power plant having a boiler for generating superheated steam at an outlet thereof, a turbine having an inlet coupled to the boiler to be rotated by the superheated steam generated within the boiler, an electric generator coupled to the turbine for generating electric power, a condenser for condensing the superheated steam spent within said turbine, a water-feed pump for feeding water from the condenser into said boiler, a main steam stop valve disposed between said boiler and said turbine for stopping the superheated steam flowing into said turbine, a turbine bypass valve connected in parallel with the main steam stop valve and said turbine for leading the superheated steam generated within said boiler into said condenser, a first sensor for detecting a first process quantity indicative of the superheated steam temperature at said boiler outlet, a second sensor for detecting a second process quantity indicative of the superheated steam pressure, a third sensor for detecting a third process quantity indicative of the temperature at the turbine inlet, a fourth sensor for detecting a fourth process quantity indicative of a start-up mode of said turbine, and a fifth sensor for detecting a fifth process quantity indicative of opening of said turbine bypass valve, comprising the steps of:

calculating a first mismatch temperature value of said turbine on the basis of said second process quantity, said third process quantity and said fourth process quantity;

calculating a second mismatch temperature value capable of leading the superheated steam into said turbine on the basis of said fourth process quantity;

comparing the first mismatch temperature value with the second mismatch temperature value;

calculating an open-direction drive quantity of said turbine bypass valve on the basis of said fourth process quantity when it is judged that the first mismatch temperature value is less than the second mismatch temperature value;

calculating a closed direction drive quantity of said turbine bypass valve on the basis of the first mismatch temperature value when it is judged that the first mismatch temperature value exceeds the second mismatch temperature value;

calculating a change rate of said first process quantity, comparing the calculated change rate with a predetermined change rate, and producing a first lock signal when said calculated change rate is smaller than the predetermined change rate;

calculating a difference between said first process quantity and said third process quantity, comparing the calculated difference with a predetermined value, and producing a second lock signal when said calculated difference is smaller than said predetermined value;

outputting an open-direction operation command signal of said turbine bypass valve on the basis of said open-direction drive quantity, said first lock signal said second lock signal; and outputting a close-direction operation command signal of said turbine bypass valve on the basis of said close-direction drive quantity and said fifth process quantity.

2. The method for controlling boiler superheated steam temperature as recited in claim 1, wherein:

said fourth process quantity is a first-stage steam-chamber inner-wall metal temperature of said turbine.

3. The method for controlling boiler superheated steam temperature as recited in claim 1, wherein said first mismatch temperature value calculating step comprises:

calculating and outputting an anticipated value of a steam temperature at a first-stage steam-chamber outlet of said turbine on the basis of said second process quantity and said third process quantity;

calculating and outputting as said first mismatch temperature value a difference between said second process quantity and the anticipated value of the steam temperature at the first-stage steam-chamber outlet of said turbine.

4. The method for controlling boiler superheated steam temperature as recited in claim 1, wherein: in the step of calculating a change rate and producing a first lock signal, said predetermined change rate is a positive value indicative that said first process quantity is in a rising direction.

5. The method for controlling boiler superheated steam temperature as recited in claim 1, wherein: in the step of calculating a difference and producing a second lock signal, said predetermined value is a positive value indicative that said first process quantity is greater than said third process quantity, or a negative value indicative that said first process quantity is slightly smaller than said third process quantity.

6. The method for controlling boiler superheated steam temperature as recited in claim 1, wherein in the step of outputting an open-direction operation command signal, said open-direction operation command signal is outputted only when neither said first lock signal nor said second lock signal is outputted.

7. The method for controlling boiler superheated steam temperature as recited in claim 1, further comprising:

converting said first process quantity, said second process quantity, said third process quantity, said fourth process quantity, and said fifth process quantity into digital quantities.

8. The method for controlling boiler superheated steam temperature as recited in claim 1, further comprising:

converting said open-direction operation command signal and said close-direction operation command signal into digital quantities.

9. A system for controlling boiler superheated steam temperature in a power plant having a boiler of generating superheated steam at an outlet thereof, a turbine having an inlet coupled to the boiler to be rotated by the superheated steam generated within the boiler, an electric generator coupled to the turbine for generating electric power, a condenser for condensing the superheated steam spent within said turbine, a water-feed pump for feeding water from the condenser into said boiler, a main steam stop valve disposed between said boiler and said turbine for stopping the superheated steam flowing into said turbine, a turbine bypass valve connected in parallel with the main steam stop valve and said turbine for leading the superheated steam generated within said boiler into said condenser, a first sensor for detecting a first process quantity indicative of the superheated steam temperature at said boiler outlet, a second sensor for detecting a second process quantity indicative of said superheated steam pressure, a third sensor for detecting a third process quantity indicative of temperature at said turbine inlet, a fourth sensor for detecting a fourth process quantity indicative of start-up mode of said turbine, and a fifth sensor for detecting a fifth process quantity indicative of opening of said turbine bypass valve, comprising:

mismatch temperature calculating means connected to receive the second, third and fourth process quantities detected by the second, third and fourth sensors, respectively, for calculating and outputting a first mismatch temperature value of said turbine on the basis of the received quantities;

calculating and comparing means connected to receive said first mismatch temperature value of said turbine and the fourth process quantity, for obtaining a second mismatch temperature value capable of leading the superheated steam into said turbine on the basis of said fourth process quantity, for comparing said first mismatch temperature value with said second mismatch temperature value, for outputting a first compared result signal when it is judged that said first mismatch temperature value is less than said second mismatch temperature value, and for outputting a second compared result signal when it is judged that said first mismatch temperature value exceeds said second mismatch temperature value first drive quantity calculating means connected to receive said first compared result signal and said fourth process quantity for calculating and outputting an open-direction drive quantity of said turbine bypass valve on the basis of said first compared result signal and said fourth process quantity second drive quantity calculating means connected to receive said second compared result signal and said first mismatch temperature value for calculating and outputting a close-direction drive quantity of said turbine bypass valve on the basis of said second compared result signal and said first mismatch temperature value;

temperature change rate calculating and comparing means connected to receive said first process quantity for calculating a change rate of said received first process quantity, for comparing the calculated change rate with a predetermined change rate, and for outputting a first lock signal when said calculated change rate is smaller than the predetermined change rate;

temperature difference calculating and comparing means connected to receive said first process quantity and said third process quantity for calculating a difference between said first process quantity and said third process quantity, for comparing the calculated difference with a predetermined value, and for outputting a second lock signal when said calculated difference is smaller than said predetermined value first operation command outputting means connected to receive said open-direction drive quantity, said first lock signal and said second lock signal for outputting an open-direction operation command signal of said turbine bypass valve on the basis of said open-direction drive quantity, said first and second block signal; and second operation command outputting means connected to receive said close-direction quantity and the fifth process quantity indicative of said turbine bypass value opening detected by said fifth sensor for outputting a close-direction operation command signal fo said turbine bypass valve on the basis of said close-direction drive quantity and said fifth process quantity.

10. The system for controlling boiler superheated steam temperature as recited in claim 9, wherein:

said fourth process quantity is a first-stage steam-chamber inner-wall metal temperature of said turbine.

11. The system for controlling boiler superheated steam temperature as recited in claim 9, wherein said mismatch temperature calculating means comprises:

first calculating means connected to receive said second process quantity and said third process quantity for calculating and outputting an anticipated value of a steam temperature at a first-stage steam chamber outlet of said turbine on the basis of said received second process quantity and said third process quantity; and second calculating means connected to receive the anticipated value of the steam temperature at the first-stage steam chamber outlet of said turbine calculated in the first calculating means and said second process quantity for calculating and outputting as said first mismatch temperature value a difference between said second process quantity and the anticipated value of the steam temperature at the first-stage steam chamber outlet of said turbine.

12. The system for controlling boiler superheated steam temperature as recited in claim 9, wherein: said predetermined change rate in said temperature change rate calculating and comparing means is a positive value indicative that said first process quantity is in rising direction.

13. The system for controlling boiler superheated steam temperature as recited in claim 9, wherein said predetermined value in said temperature difference calculating and comparing means is a positive value indicative that said first process quantity is greater than said third process quantity or a negative value indicative that said first process quantity is slightly smaller than said third process quantity.

14. The system for controlling boiler superheated steam temperature as recited in claim 9, wherein:

said first operation command outputting means outputs said open-direction operation command signal only when neither said first lock signal nor said second lock signal is outputted.

15. The system for controlling boiler superheated steam temperature as recited in claim 9, further comprising:

a process input unit connected to receive said first process quantity, said second process quantity, said third process quantity, said fourth process quantity and said fifth process quantity for converting and outputting these received process quantities as digital quantities.

16. The system for controlling boiler superheated steam temperature as recited in claim 9, further comprising:

a process output unit connected to receive said open-direction operation command signal and said close-direction operation command signal for converting and outputting these received signals as digital quantities.

* * * * *